United States Patent [19]

Denda

[11] Patent Number: 4,709,531

[45] Date of Patent: Dec. 1, 1987

[54] STRETCH FILM PACKAGING MACHINE

[75] Inventor: Toshio Denda, Tokyo, Japan

[73] Assignee: Teraoka Seiko Co., Ltd., Tokyo, Japan

[21] Appl. No.: 735,134

[22] Filed: May 17, 1985

[30] Foreign Application Priority Data

May 23, 1984 [JP] Japan ..... 59-76300[U]
Jul. 31, 1984 [JP] Japan ..... 59-118936[U]

[51] Int. Cl.[4] ..... B65B 11/18; B65B 53/00; B65B 61/00

[52] U.S. Cl. ..... 53/415; 53/441; 53/66; 53/137; 53/228; 53/556; 198/456; 198/461; 198/586

[58] Field of Search ..... 53/66, 228, 230, 137, 53/556, 232, 415; 198/466, 441, 456, 586, 461, 468.8; 271/250

[56] References Cited

U.S. PATENT DOCUMENTS

| | | | |
|---|---|---|---|
| 2,077,431 | 4/1937 | Neumair | 53/232 X |
| 2,095,104 | 10/1937 | Smith | 53/230 |
| 2,180,163 | 11/1939 | Milmoe | 198/468.8 X |
| 3,138,905 | 6/1964 | Ellinger | 53/228 X |
| 3,662,513 | 5/1972 | Fabbri . | |
| 3,908,333 | 9/1975 | Cavanna | 198/461 X |
| 4,078,363 | 3/1978 | Ranzi | 53/228 |
| 4,178,286 | 4/1916 | Anderson | 271/250 |
| 4,188,027 | 2/1980 | Naumann | 271/250 X |
| 4,264,068 | 4/1981 | Melzer | 271/250 |
| 4,415,048 | 11/1983 | Teraoka . | |
| 4,458,470 | 7/1984 | Fine . | |
| 4,489,533 | 12/1984 | Treiber . | |
| 4,505,092 | 3/1985 | Bowers et al. . | |
| 4,543,766 | 10/1985 | Boshinski | 53/566 X |

FOREIGN PATENT DOCUMENTS

| | | | |
|---|---|---|---|
| 113847 | 3/1925 | Switzerland | 53/230 |

*Primary Examiner*—John Sipos
*Attorney, Agent, or Firm*—Sandler & Greenblum

[57] ABSTRACT

This invention relates to a packaging machine in which an item is stored on a container such as tray. The container is mechanically and automatically packaged in a bag-form with a stretch film. The film is folded down to the bottom surface of the container. The width of the container may be different in size. A label can be attached to a desired position on the item.

17 Claims, 30 Drawing Figures

| | |
|---|---|
| FIG. 19A | FIG. 19B |

STRETCH FILM PACKAGING MACHINE

BACKGROUND OF THE INVENTION

1. Field of the Invention

This invention relates to a stretch film packaging machine, and more particularly to a packaging machine in which some items such as raw fresh foodstuffs and other foodstuffs sold in a super-market or a department store, etc. are mounted on a container such as a tray, etc. The container is covered by a stretch film and the film is folded down over the tray, thus packaging the item.

2. Description of the Prior Art

A stretch film packaging machine which has been developed in recent years is constructed such that both the size of the packaging tray and the height of the stored item are automatically sensed and a length of the film to be cut is defined based on the result of this sensing operation. Thus, the mechanism assures positive and superior packaging even if the size of the tray to be packaged is varied. Such a packaging machine as described above is made such that the tray is normally fed into the machine in a direction perpendicular to the film feeding direction.

A machine which does not have the above-noted sensing means and provides for the setting of a specified length of the film to be used has also been made. This construction is employed because there are several trays presently used with different lengths, ranging from long ones to short ones, rather than trays with different widths and the machine aims to have a wide range of trays which can be used and still assure positive and superior packaging. However, in this case, since the film length in the width of the tray is always kept constant as long as the applied film is not changed, the following disadvantages may be found. It is necessary for the feeding conveyor at the in-feed or entrance part of the conventional type of machine to provide intermittent feeding of the packaged item, so that, as shown in FIG. 16, pusher conveyor 1 is applied. This unit is required because the item or tray A properly mounted on the conveyor is transported in synchronism with the vertical movement of elevator head 2 and the delivery of the tray A onto elevator head 2 is performed by the end part of pusher conveyor 1 due to the performance of pusher conveyor 1.

Therefore, when a narrow width tray, such as a tray for storing mackerel pikes is to be packaged, a substantial margin C of the film b remains. This margin C does not cause any problem in a packaging machine (FIGS. 12 to 14) where the feeding-out or exit port 12 is on the same side as the feeding-in or entrance port 11. However, as shown in FIG. 16, in the case of a packaging machine (FIGS. 9 to 11) where the tray exit 12 is placed opposite to the entrance port 11 a problem occurs. As is shown in FIG. 17, folding plate 4 moves the tray A toward exit or feeding-out conveyor 34 when the front part of the film has been folded, which results in that packaging may not be performed in a superior manner, and ultimately, packaging might not be completed at all.

Element 1 in FIG. 16 designates a pusher conveyor. Elevator head 2 is arranged at the feeding-out end or output of pusher conveyor 1, such that elevator head 2 may be moved up and down. Lateral folding plates 3, 3' front folding plate 4, discharging pusher 35 and heating belt 34 are arranged over elevator head 2. When item A is mounted on elevator head 2 by pusher conveyor 1, whereby item A is raised up, additional margin C is produced at the film b near heating belt 34. Therefore, when the film is folded by front folding plate 4, it results in the form as shown in FIG. 17. Due to this arrangement, in the conventional type of the device as above, the kind of tray which may be used and which will still assure a superior packaging is limited.

In order to eliminate the above-mentioned problems, it has been developed to make a packaging machine wherein the width of the tray to be packaged is detected, and the length of movement of the folding plate is controlled in response to the width of the tray. Since the device is constructed such that the mechanical parts are not operated by an electric motor, but by compressed air, the control of the length of movement of the folding plate is relatively simple. Where the mechanical parts are operated by compressed air, a facility for supplying the compressed air such as an air compressor is required, so that the entire unit becomes large in size and heavy in weight. Since the width of the tray is detected and controlled, the control circuit becomes complicated. The processing speed of this type of machine is also restricted.

In the above-noted stretch film packaging machine, the items are packaged with a stretch film. Thereafter the packaged items are transferred onto heating belt 34, the bottom part of the folded stretch film is sealed and at the same time the unit price, weight and price of the items are printed on the label by the label printer and the printed label is adhered or attached to the packaged items. It is necessary to attach the above-noted label at any one of the four corners of the container (item) because attaching the label in the center of the item may cause the customer to have a restricted view of contents of the container.

Random adherence of the label on the container or irregular adherence thereof may not only adversely effect the outer appearance, but also degrade or reduce the value of item, so that careful attention must be paid to the position of the adherence of the label at the supermarket.

The adhering position of the label printer must always be moved each time the size of the item to be packaged is varied. A trial adherence of a label must be done, resulting in quite a troublesome operation.

It has previously been proposed that in the conventional type of packaging machine a weighing device and a label applying device are integrally assembled to adhere the label to the item on the heating belt. However, the label may not be adhered in the same position unless the label adhering position of the label printer is moved in response to the size of the item to be packaged.

SUMMARY OF THE INVENTION

It is an object of the present invention to provide a stretch film packaging machine in which the above-mentioned disadvantages of the conventional type of the machine are eliminated and a superior finished packaging condition may always be assured even when trays storing the item are to be packaged which have different widths.

It is another object of the present invention to provide a packaging machine which is small in size and light in weight and has a relatively simple structure, and in particular which is suitable for operation by an electric motor.

It is a still further object of the present invention to provide a stretch film packaging machine in which a label can always automatically be adhered at a desired position on the item without requiring any adjustment even if the size of the item packaged by a stretch film is varied.

It is yet a still further object of the present invention to provide a stretch film packaging machine in which the direction of the item discharging port can be varied by an angle of 180° under a simple change-over operation of a member.

The above-mentioned present invention relates to a stretch film packaging machine in which an elevator head is arranged at the discharging end of a pusher conveyor. The elevator head is arranged so that it may be moved up and down. The pusher conveyor is positioned downstream of the elevator head. A piece of stretch film, cut to a suitable length, is held above the elevator head. An opening part or passage having a folding plate for folding the bottom part of the stretch film which covers the item when the tray is placed on the elevator head is formed above the stretch film. The folding part is slidable when the elevator head is raised toward the opening. The item is discharged to the opposite side of the pusher conveyor. A conveyor belt is arranged from the discharging end of the pusher conveyor to the downstream position of the elevator head. A position setting plate is projected in the desired position at the discharging end of the conveyor belt. The item is packaged by the stretch film and the item is mounted on the heating belt to seal the bottom. A label is issued from a label printer and adhered to the item. Position setting side plates are arranged at the side of the heating belt. A sliding plate is arranged on the upstream side of the feeding-in part of the heating belt so that it may slide along the width of the heating belt. The packaged item is moved on the sliding plate, the item is abutted against the side plate, transferred onto the heating belt, and then transported along the side plates.

Description of the Preferred Embodiments

Figure 1:
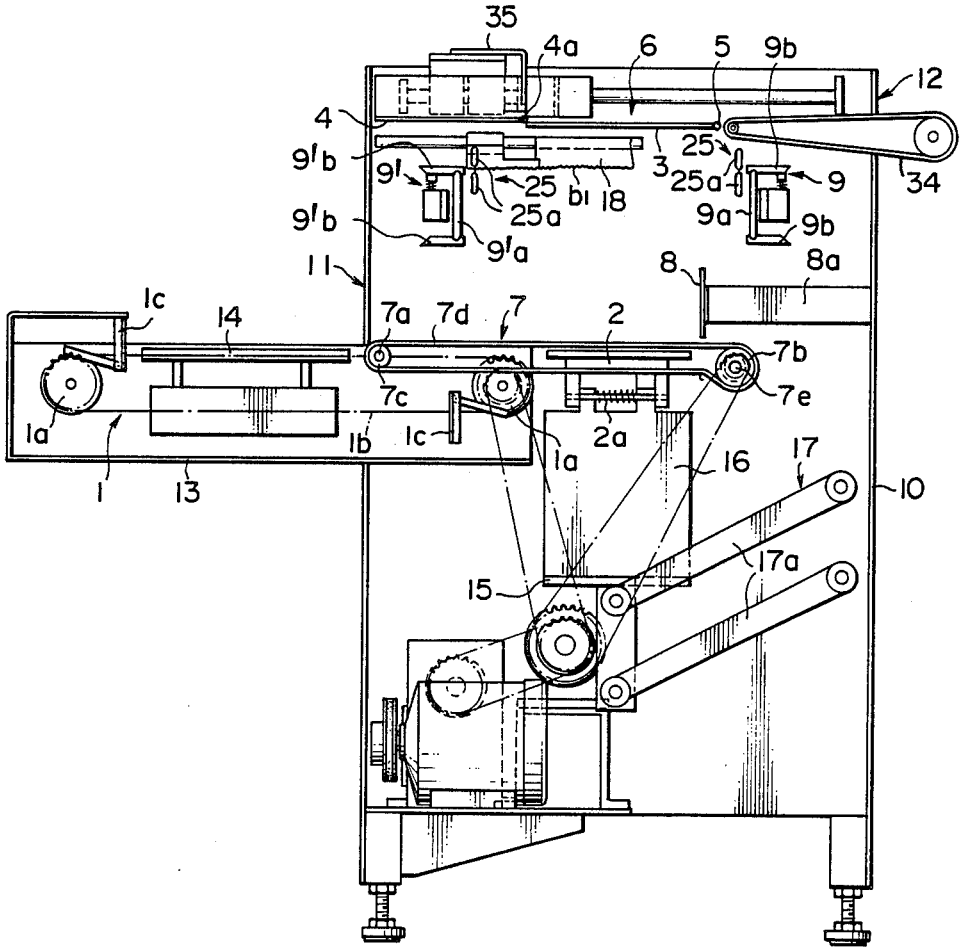
FIG. 1 is a longitudinal side elevational view in section for showing the packaging machine of the present invention.

In FIGS. 1 to 5, machine frame 10 consists of a substantially rectangular frame provided with item feeding or entrance port 11 at its front central part and packaged item feeding-out or exit port 12 at the rear upper part thereof.

Feeding frame 13 is arranged to project forwardly from below entrance port 11. Pusher conveyor 1 extends from feeding frame part 13 into machine frame 10.

Pusher conveyor 1 is constructed such that chain 1*b* is arranged between sprockets 1*a*, 1*a* and pusher 1*c* is connected to chain 1*b*. The item placed at the feeding end is pushed into machine frame 10 by pusher 1*c*.

Weighing part 14 is arranged at the feeding end of pusher conveyor 1 so as to weigh the item placed on weighing part 14. Pusher conveyor 1 is turned on and starts moving when a weighing stable signal is produced.

At the discharging end of pusher conveyor 1 are arranged a plurality of elevator heads 2. The lowest position of each of the elevator heads 2 is such that the top of the elevator head is flush with pusher conveyor 1.

Figure 2:
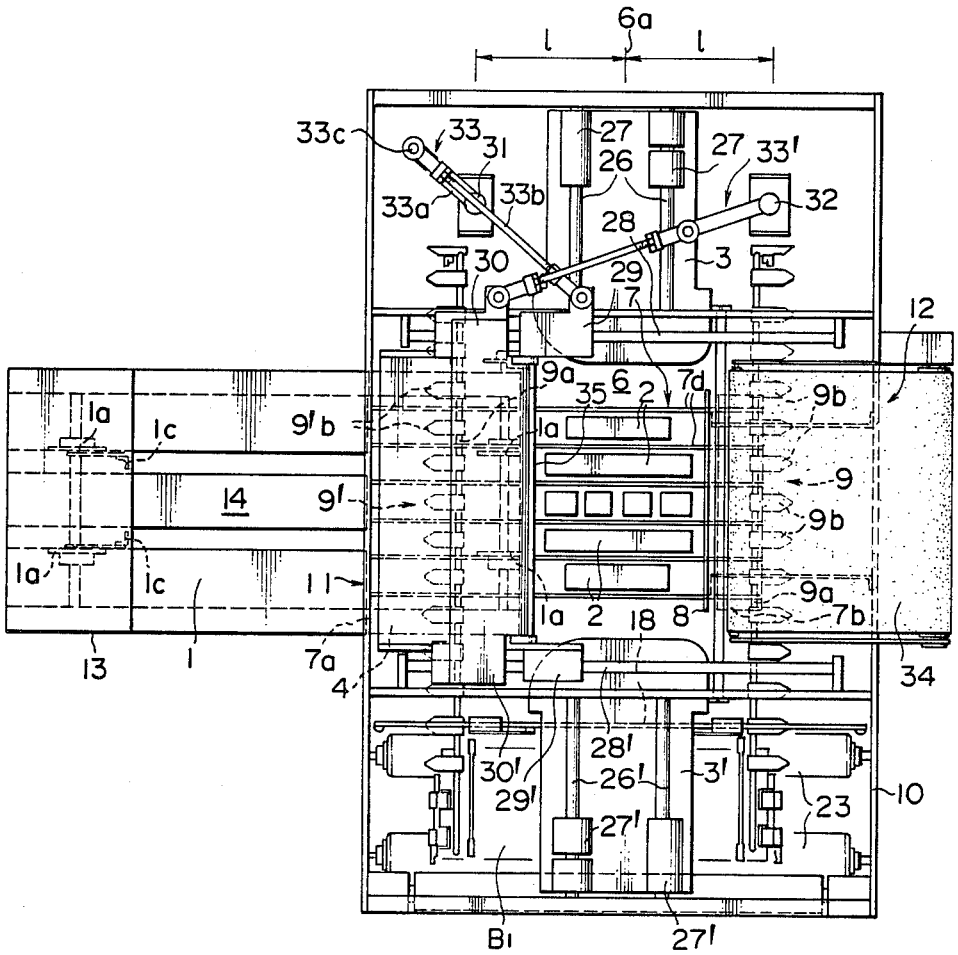
FIG. 2 is a top plan view in section of FIG. 1.
Figure 4:
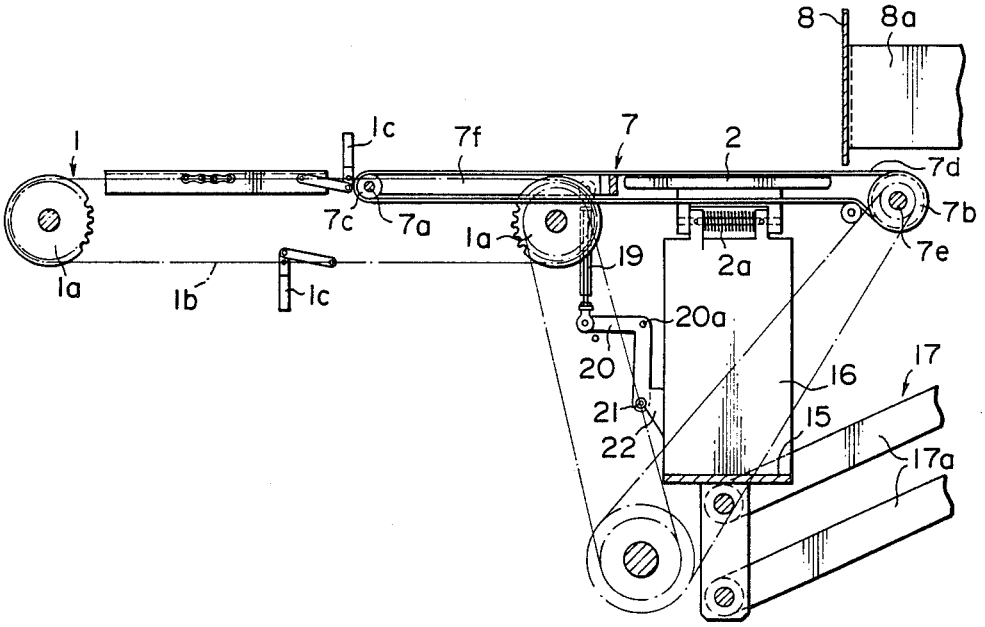
FIG. 4 is an enlarged view for showing a substantial part of FIG. 1.
Figure 5:
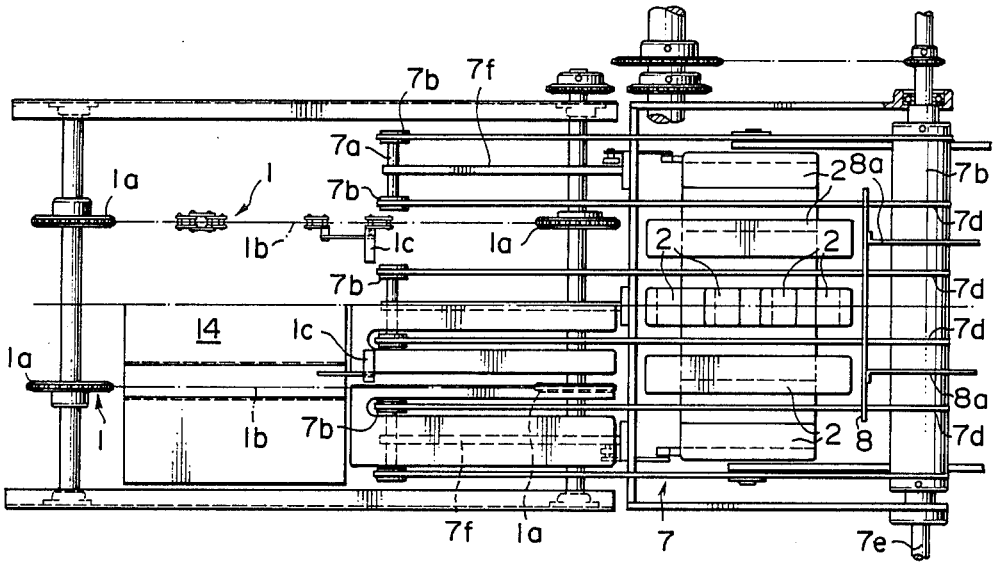
FIG. 5 is an enlarged view for showing a substantial part of FIG. 2.

Each of the elevator heads 2 consists of an item mounting table which is raised and lowered by each of the springs 2*a*. Springs 2*a* are mounted on a plurality of raised fixed plates 16 (as best shown in FIG. 4). Raised fixing plates 16 are arranged side-by-side on mounting plate 15 in a properly spaced-apart relationship. The heads are distributed so as not to disturb the folding operation of lateral folding plates 3 and 3' and front folding plate 4, as best shown in FIG. 2. Mounting plate 15 is moved up and down by elevator mechanism 17. Elevator mechanism 17 rotates a cam (not shown) which moves parallel oscillating arms 17*a* and 17*a* up and down. The highest positions of each of the elevator heads 2 is adjacent to opening 6 to be described later.

A plurality of belt conveyors 7 are installed from the discharging end of pusher conveyor 1 extending toward the plurality of elevator heads 2. Belt conveyors 7 are arranged as follows. Pivot shaft 7*a* is rotatably arranged at the output part of pusher conveyor 1, that is, close to scale 14. A plurality of pulleys 7*c* are arranged at pivot shaft 7*a* such that belts 7*d*, to be described later, are positioned between elevator heads 2. Drive rollers 7*b* are installed at the rear sides of elevator heads 2, and belts 7*d* are tensioned between pulleys 7*c* and drive rollers 7*b*. Belt conveyors 7 are operated such that their pivot shafts 7*a* are oscillated in an upward and downward direction about drive shaft 7*e* of drive rollers 7*b*.

A microswitch or photo-sensor is mounted near the item entrance port 11 so as to detect the size of the item which is being packaged. The film is cut by cutter 18, to be described later, to the proper length which coincides with the size of the item.

As best illustrated in FIG. 4, a plurality of side plates 7*f* associated with pivot shaft 7*a* are provided with pivotable connector levers 19. L-shaped levers 20, having fulcrum shafts 20*a* as their rotational centers, are rotatably connected to connector levers 19. Rollers 21 are connected below L-shaped levers 20. When elevator heads 2 are placed at their lowest position, triangular projecting pieces 22 which are positioned near fixing plates 16, abut against rollers 21 to cause belt conveyors 7 to be projected over pusher conveyor 1. When elevator heads 2 are moved upwardly, rollers 21 descend along the inclined surfaces of projecting pieces 22, so that belt conveyors 7 are oscillated downwardly about drive shaft 7e and positioned below pusher conveyor 1.

Fixing plates 8*a* are positioned inside of the rear part of machine frame 10, and position setting plate 8 is arranged at fixing plates 8*a* such that position setting plate 8 may be positioned at a place slightly apart from elevator heads 2.

Position setting plate 8 abuts against the item to be transported by belt conveyors 7 and positions the item at the feeding reference positions of elevator heads 2.

The feeding speed of belt conveyors 7 is set at a faster speed than that of pusher conveyor 1. The speed of belt conveyors 7 keeps the packaging cycle, to be described later, at a constant rate and prevents the processing power from decreasing.

Movement of pushers 1*c* of pusher conveyor 1 is mechanically synchronous with one cycle of the packaging operation of the packaging machine. That is, the item placed at the input part of pusher conveyor 1 is transported by pushers 1c to elevator heads 2 in synchronism with one cycle of the packaging operation of the packaging machine. Therefore, it becomes necessary to provide for intermittent feeding of an item by the input or feeding-in conveyors. Processing capacity of the packaging machine is defined by the feeding volume of pushers 1*c*. Since the distance between the surface of the item which will abut position setting plate 8 at the starting position of the item and position setting plate 8 is different by the depth length of the item, when the item transported by pusher conveyor 1 is fed to elevator heads 2 the transporting time of each item is different from item to item. In order to keep the processing capacity of the packaging machine constant as the depth length of the item varies, the transporting speed of belt conveyor 7 is defined as the speed at which the item having a lower depth length can be abutted against position setting plate 8 while elevator heads 2 are stopped at their lowest positions.

In order to increase the processing capacity, it is preferable to shorten the transporting distance of pusher conveyor 1. In the preferred embodiment, pusher conveyor 1 and belt conveyors 7 are overlapped with one another. If the depth length of one item is different from that of another item, the item having a longer depth lengeth reaches belt conveyors 7 first. In this case, the movement of the item may not coincide with the timing of the upward and downward movement of elevator heads 2. This would result in the item not being placed on elevator heads 2. Therefore, in order to cause the items having different depth length to always be placed on elevator heads 2, belt conveyors 7 are moved in an upward direction to transport the item when elevator heads 2 are in their lowest position. In this case, the driving of belt conveyors 7 may be controlled, or a shutter is arranged without any upward or downward movement of belt conveyors 7.

A set of film transporting devices 9 and 9' are arranged above elevator heads 2 in such a way as they are crossed with, i.e., perpendicular to, the feeding direction of the item. Cutter 18 is arranged above the feeding part of transporting devices 9 and 9', and supporting rollers 23 for film rollers $B_1$ and $B_2$ are arranged below transporting devices 9 and 9'.

Figure 3:
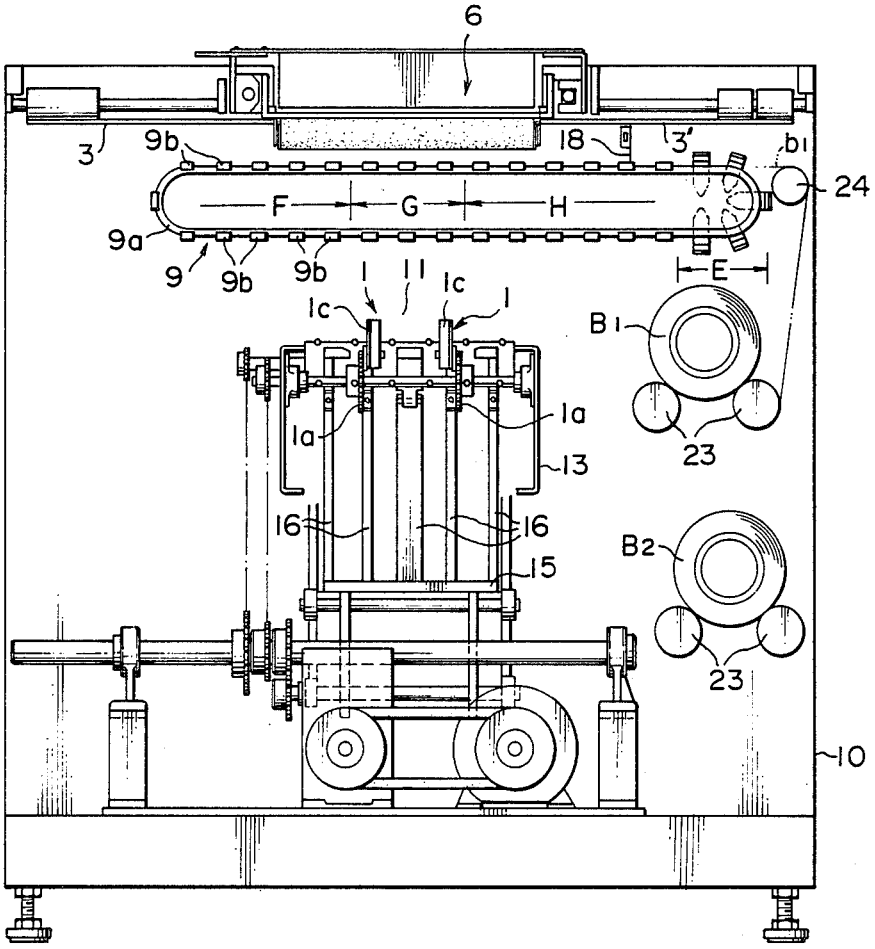
FIG. 3 is a longitudinal front elevation view in section of FIG. 1.

Two sets of two supporting rollers 23 are rotatably arranged so as to support rolls $B_1$ and $B_2$ having different film widths. Stretch film $b_1$ which feeds from roll $B_1$ is passed through film feeding roller 24 to transporting devices 9 and 9', as shown in FIG. 3.

Film transporting roller 24, arranged at the feeding part of transporting devices 9 and 9', is rotated for a certain period of time at a specified speed while the stretch film $b_1$ is unrolled.

Cutter 18 is arranged above the transporting side of transporting devices 9 and 9' so that it can be moved up and down. In this way, film $b_1$ unrolled from film transporting roller 24 is cut to a desired length.

Each of the holder devices 25 is arranged inside the transporting part of transporting devices 9 and 9', respectively, as shown in FIG. 1. Each of the holding devices 25 is composed of a set of upper and lower rubber belts 25*a*. The end part of film $b_1$ of film roll $B_1$ is held between roller belts 25*a*.

Since transporting devices 9 and 9' are of a symmetrical structure around the center of the opening or passage 6 for their front and rear parts, only one of them will be described with reference to FIG. 3. The transporting device 9 is constructed such that some sprockets (not shown) are arranged at both sides of machine frame 10 and chains (not shown) are tensioned between the sprockets. A round belt 9*a* is applied along the outer circumference of the chains, and at the same time a plurality of grippers 9*b* are arranged in a specifed spaced apart interval at the chains so that they may be opened or closed. Stretch film $b_1$ is held by grippers 9*b* and round belt 9*a* and is transported thereby. A guide (not shown) for opening grippers 9*b* is arranged at the feeding part E of the transporting device 9 shown in FIG. 3, and grippers 9*b* are released at the feeding part E. An additional guide (not shown) for closing grippers 9*b* is arranged starting from the feeding part E toward the feeding direction so as to close grippers 9*b*. The guide for grippers 9*b* is divided into three blocks of F, G, and H, shown in FIG. 3. A solenoid (not shown) is arranged for each of the blocks F, G, and H, and the guide is movable in response to the solenoid so as to open or close grippers 9*b*. When stretch film $b_1$ is held and unrolled, all the blocks F, G, and H are closed. When the lateral folding is performed, the blocks F and H at both ends are released in synchronism with the timing of the lateral folding operation of lateral folding plates 3 and 3'. When either front folding or rear folding is to be performed, the block G is released in synchronism with the timing of the folding of front folding plate 4 or discharging pusher 35.

In the above-mentioned transporting devices 9 and 9', the transporting speed of round belt 9*a* and grippers 9*b* is a little faster than the unrolling speed of film feeding roller 24, such that film $b_1$ can be extended along the transporting direction. Similarly, a space between transporting devices 9 and 9' can be gradually widened along the transporting direction, such that the width of film $b_1$ can be extended. In this way, the film is properly extended to enable a superior finished packaging operation.

Lateral folding plates 3 and 3' are arranged horizontally, opposite to one another at the upper side of machine frame 10. Front folding plate 4 is bridged over the front end of lateral folding plates 3 and 3' and at the same time rear folding roller 5 is arranged at the rear end of lateral folding plates 3 and 3'.

The substantially rectangular opening or passage 6 is positioned just above elevator heads 2.

Lateral folding plates 3 and 3' are each a flat plate which have both ends of the side adjacent to the opening 6 having an arcular form, as shown in FIG. 2, so as to fold the film at the side of the item. Parallel guide bars 26 and 26' are directed toward the opening 6 and are arranged at the upper sides of machine frame 10. Each of the sliding members 27 and 27' are slidably arranged at guide bars 26 and 26'. Lateral folding plates 3 and 3' are fixed to the lower parts of sliding members 27 and 27'. Sliding members 27 and 27' are cooperatively related to the drive shaft (not shown) through a crank mechanism (not shown). Lateral folding plates 3 and 3' are synchronously moved into and out of opening 6.

Front folding plate 4 is a flat plate. Front folding roller 4a is rotatably arranged at the side of front folding plate 4 adjacent to the opening 6, as shown in FIG. 1. Front folding plate 4 performs the front holding operation after completion of the lateral folding by lateral folding plates 3 and 3'. Each of the side guide rails 28 and 28', as shown in FIG. 2, are arranged at both sides of opening 6 of machine frame 10. Each of the first sliding members 29 and 29' and the second sliding members 30 and 30' are slidably arranged at each of the guide rails 28 and 28'. Front folding plate 4 is bridged over first sliding members 29 and 29'. Sliding member 29 and first drive shaft 31 are cooperatively related to each other via crank shaft 33 so as to cause front folding plate 4 to be moved into and out of opening 6. Crank mechanism 33 is made such that rotating lever **33*a* fixed to first drive shaft 31 and cooperating lever 33*b* are rotatably connected through pivot shaft 33*c***.

Discharging pusher 35 is bridged over second sliding members 30 and 30'. Sliding member 30 and second drive shaft 32 are cooperatively connected through crank mechanism 33' having the same structure as that of crank mechanism 33. The item, after lateral folding and front folding have been completed, is discharged to heating belt 34 by discharging pusher 35.

As described above, guide rails 28 and 28' are used both for first sliding members 29 and 29' and for second sliding members 30 and 30', so that the structure is quite simple and compact.

First drive shaft 31 and second drive shaft 32 are arranged at a position of linear symmetry with an equal distance of l, around central line **6*a* of opening 6 as shown in FIG. 2**.

Figure 12:
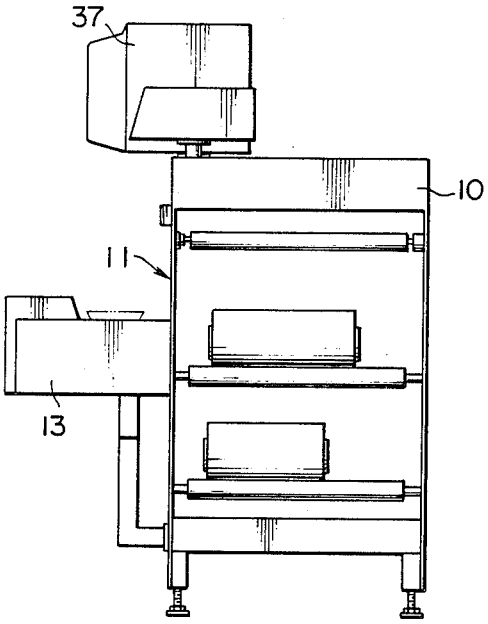
FIG. 12 is a side elevational view of an outer appearance of a packaging machine in operation in which the feeding-in port and the feeding-out port are arranged on the same side.
Figure 13:
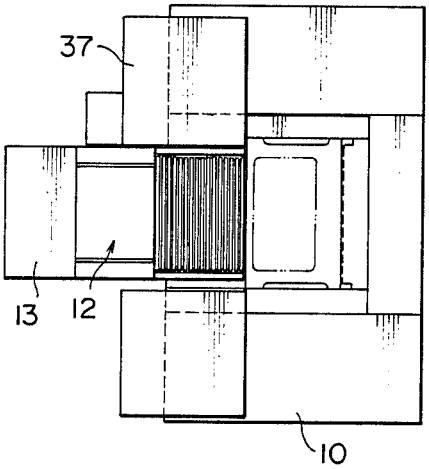
FIG. 13 is a top plan view of FIG. 12.
Figure 14:
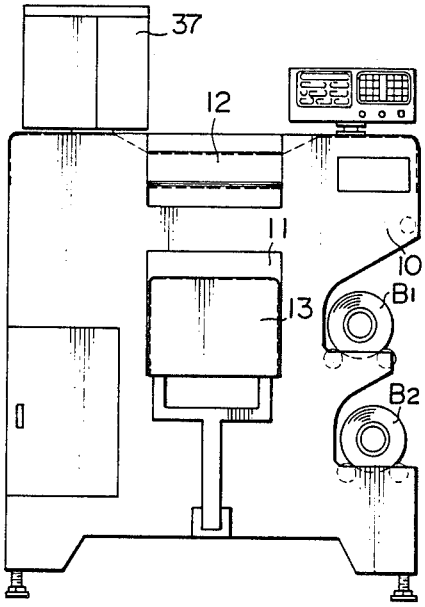
FIG. 14 is a front elevational view of FIG. 12.

Since first drive shaft 31 and second drive shaft 32 are arranged at a symmetrical position around the center line **6*a* of opening 6, it is possible to make a packaging machine in which entrance port 11 and exit port 12 are oriented toward the same direction, as shown in FIGS. 12 to 14, by merely exchanging the positions of each of the folding plates 3, 3', and 4, discharging pusher 35 and the heating belt 34**, etc.

Figure 6:
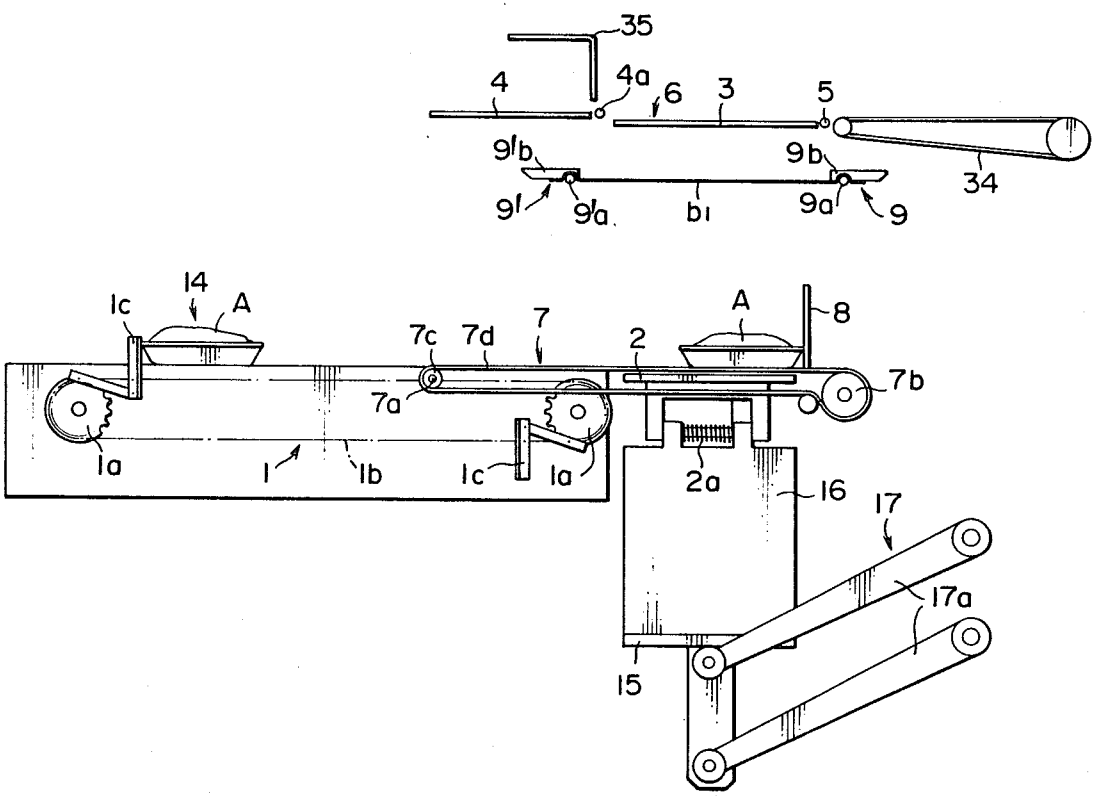
FIGS. 6 to 8 are views for showing an operation starting from a feeding-in of the item to packaging by a stretch film in the present invention.

Rear folding roller 5, shown in FIG. 6, is a longitudinal roller which is rotatably arranged so as to discharge the item which is pushed by discharging pusher 35. The film has been laterally folded, folded in the front part of the item and is thus folded in the rear of the item by rear folding roller 5.

Heating belt 34 is a belt conveyor having a heater stored therein. Heating belt 34 cooperates with rear folding roller 5 so as to heat the film folded at the bottom part of the item and to discharge the same.

Figure 9:
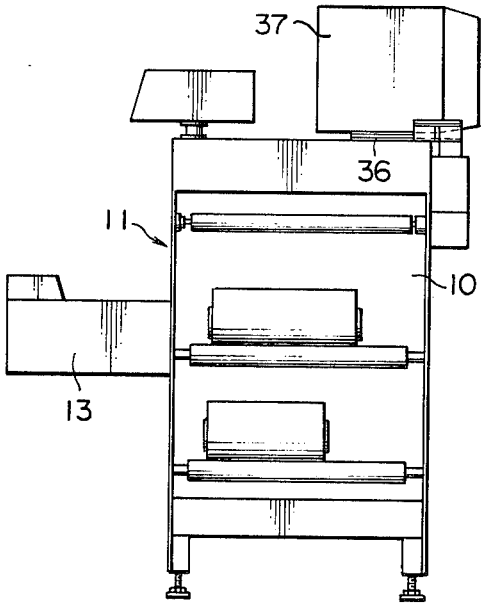
FIG. 9 is a side elevational view of the outer appearance of the stretch film packagaing machine.
Figure 10:
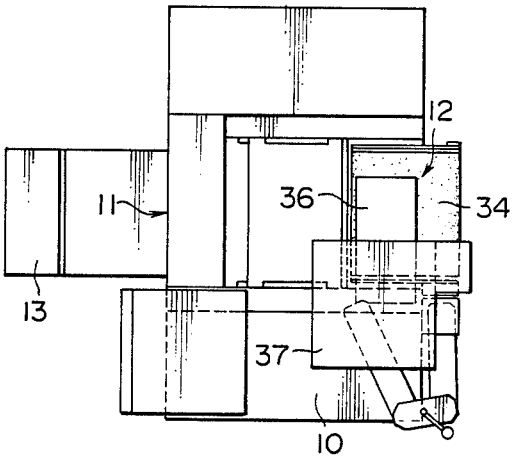
FIG. 10 is a top plan view of FIG. 9.
Figure 11:
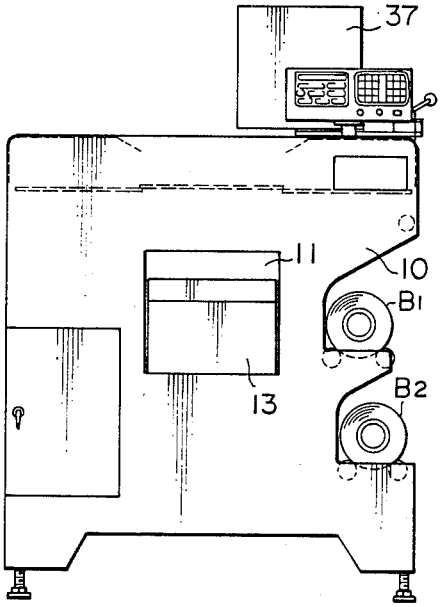
FIG. 11 is a front elevational view of FIG. 9.

Sliding plate 36 is arranged at the discharging part of heating belt 34 as shown in FIGS. 9 to 11. Sliding plate 36 is arranged so as to be slidably moved along the width of heating belt 34. The item which is pushed by discharging pusher 35 and folded at its rear part by rear folding roller 5 is received by sliding plate 36. Then, if sliding plate 36 is moved down, the item is transferred onto heating belt 34, positioned at one side of heating belt 34. Therefore, the label adhering position is kept constant when an automatic label adhering operation is performed with label printer 37 installed above the output side of heating belt 34. The construction near heating belt 34, in particular, sliding plate 36 and its function, will be described later in reference to FIGS. 18 to 28.

Each of the movable parts is cooperatively moved by a mechanical synchronous operation coinciding with the upward and downward movement of elevator heads 2.

Operation of the packaging machine of the present invention will now be described in reference to FIGS. 6 to 8.

At first, pusher conveyor 1 and elevator heads 2 are kept empty. When the first item A is placed on weighing part 14, pusher conveyor 1 and belt conveyor 7 are started, thus transporting item A. The size of the transported item A is detected by a microswitch or photosensor installed at feeding entrance port 11 and a length of film $b_1$ which coincides with the item A is defined. Film $b_1$, having the defined length, is unrolled by transporting devices 9 and 9' and film $b_1$ is cut to the defined length by cutter 18. The cut film $b_1$ is transported and held by transporting devices 9 and 9' so that its center part coincides with the center of opening 6. During this operation, a vacant feeding is performed at once for the elevator heads 2, lateral folding plates 3 and 3', front folding plate 4 and the discharging pusher 35. Elevator heads 2 are returned back to their lowest position and the first item A transported by belt conveyor 7 is transported until it abuts against position setting plate 8 and its position is set.

As illustrated in FIG. 6, if the second item A is mounted on weighing part 14, pusher conveyor 1 and belt conveyor 7 are turned on by a weighing stable signal so as to transport the second item A, and at the same time, the first item A on elevator heads 2 is raised by elevator heads 2.

Figure 7:
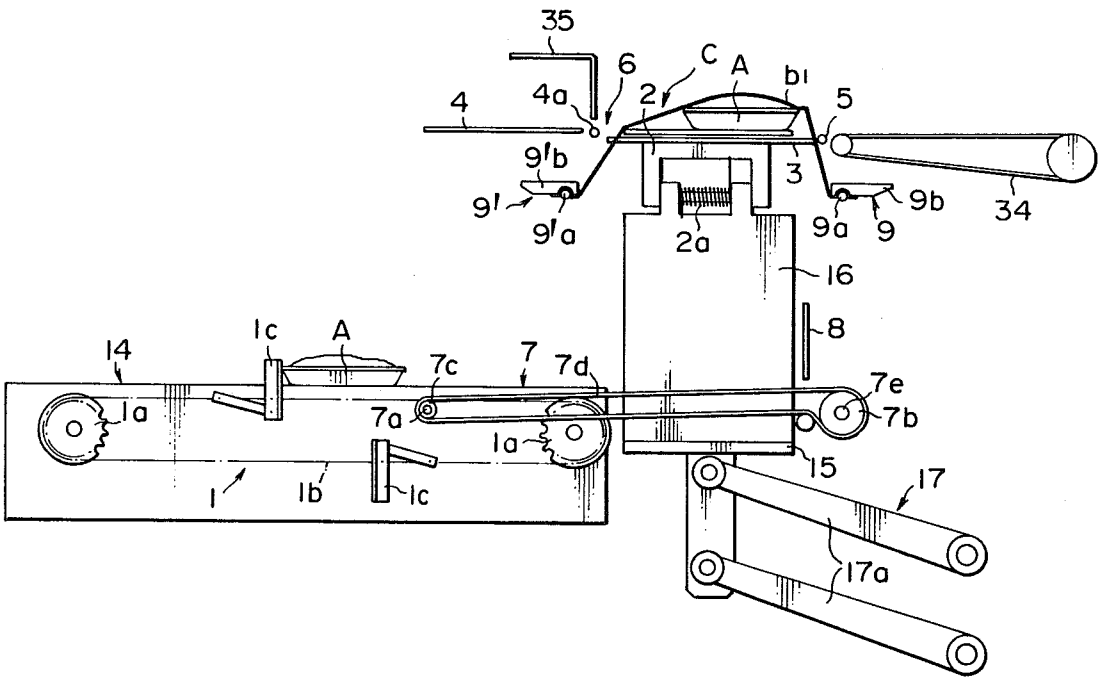

FIG. 7 illustrates the raising of the first item A on elevator heads 2. As elevator heads 2 are raised, roller 21 in FIG. 4 is released from projecting piece 22, causing pivot shaft **7*a* of belt conveyor 7 to be oscillated downwardly around drive shaft 7e, as shown in FIG. 7**, and kept immovable.

The item A on elevator heads 2 pushes up against film $b_1$ and is stopped at the highest position of elevator heads 2, i.e., at opening 6.

Figure 8:
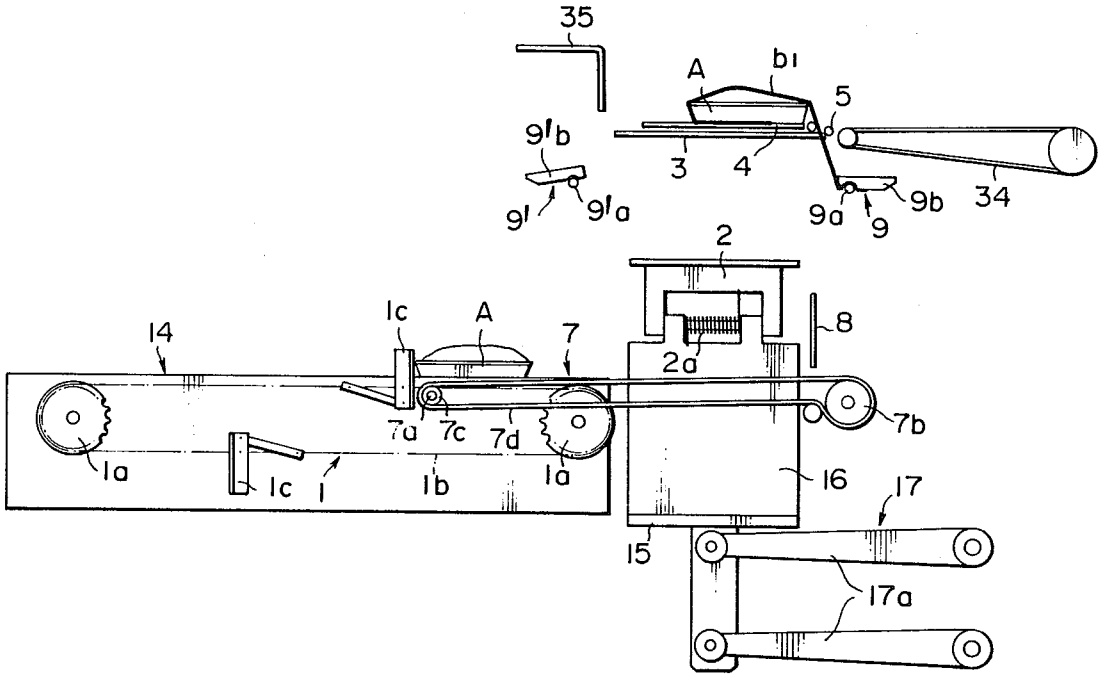

FIG. 8 illustrates the lateral folding and front folding operations. As elevator heads 2 achieve their highest position, lateral folding plates 3 and 3' can be moved to the center of the bottom surface of the item A while pushing elevator heads 2. Thus, the films at both sides of the item A are folded under the bottom part of the item A.

Upon completion of the folding of the film at the sides of the item, front folding plate 4 is moved to the bottom surface of the item A to perform the folding of the film at the front of the item. As roller 4*a* of front folding plate 4 reaches rear folding roller 5, discharging pusher 35 starts moving, and at the same time, elevator heads 2 descend.

The item A is transported to rear folding roller 5 by discharging pusher 35, thus accomplishing the folding of the film at the rear of the item.

The item A, after rear folding is completed, is received on sliding plate 36, to be described later, and its position is set by making sliding plate 36 immovable. The item is heat sealed by heating belt 34. Then, the label is attached to the item by label printer 37.

As discharging pusher 35 pushes the item A against sliding plate 36 on heating belt 34, lateral folding plates 3 and 3' and front folding plate 4 are returned to their initial positions and immobilized, at the same time elevator heads 2 are returned to the lowest position.

As elevator heads 2 are returned back to the lowest position, projecting piece 22 shown in FIG. 4, abut against roller 21, causing pivot shaft 7*a* of belt conveyor 7 to be projected again, resulting in the configuration shown in FIG. 6.

Subsequently, when the third item or any items thereafter are packaged, the processing steps for the second item are repeated.

As the packaging operation approached the end and the final item A is mounted on weighing part 14, pusher conveyor 1 and belt conveyor 7 start to operate to cause the item A to be transported onto elevator heads 2 and abutted against position setting plate 8.

At this time, the operation of the main driving motor and each of the movable parts is stopped.

Then, when the manual button is depressed, elevator heads 2 are lifted up to fold the item A in the same manner as that of the previous step and the item A is discharged. Lateral folding plates 3 and 3', front folding plate 4 and discharging pusher 35 are stopped and immobilized in their initial positions, and elevator heads 2 are stopped in their initial positions, that is, their lowest positions.

In case the items were not placed on the weighing part within the desired period of time (for example, one cycle of the pusher), a vacant operation may automatically be performed. In accordance with the present invention described above, the arrangement of belt conveyor 7 and position setting plate 8 causes the margin C of the film to be generated at the front folding plate irrespective of such an arrangement as the item is input in synchronism with the upward and downward movement of the elevator. Due to this fact, since the margin of the film b is folded by front folding plate 4, for example, even where a narrow tray as one for storing mackerel spikes is packaged, the tray is not moved and superior packaging is performed. Further, since a superior packaging can always be performed only by driving belt conveyor 7 arranged at the output end of pusher conveyor 1 without having any relation to the width of the tray, the present invention is suitable for driving by an electric motor. The entire structure is small in size and light in weight in comparison to that of the conventional machine in which the width of the tray is detected and the moving distance of the front folding plate is controlled in response to the width of the tray. The arrangement of the control circuit of the present invention is simple and the processing speed required for performing the packaging is improved.

Where, as shown in FIGS. 12 to 14, the packaging device is operated such that entrance port 11 and exit port 12 are arranged on the same side, the above-noted operation of belt conveyor 7 is stopped. That is, belt conveyor 7 is fixed at the position where it is flush with pusher conveyor 1 and the rotation of the conveyor is stopped. The item A to be transported by pusher conveyor 1 is slid onto belt conveyor 7. In the operative condition shown in FIGS. 12 to 14, the surface of the pusher of pusher conveyor 1 may act as a reference plane and no margin C described above is produced at exit port 11, so that the film may positively be folded. Further, the item to be transported by pusher conveyor 1 is slid on belt conveyor 7, so that a substantial inertia may not act upon the item A due to its sliding friction and so that the item A can be stopped at the desired position on elevator head 2 and the reference position can correctly be set.

Figure 15:
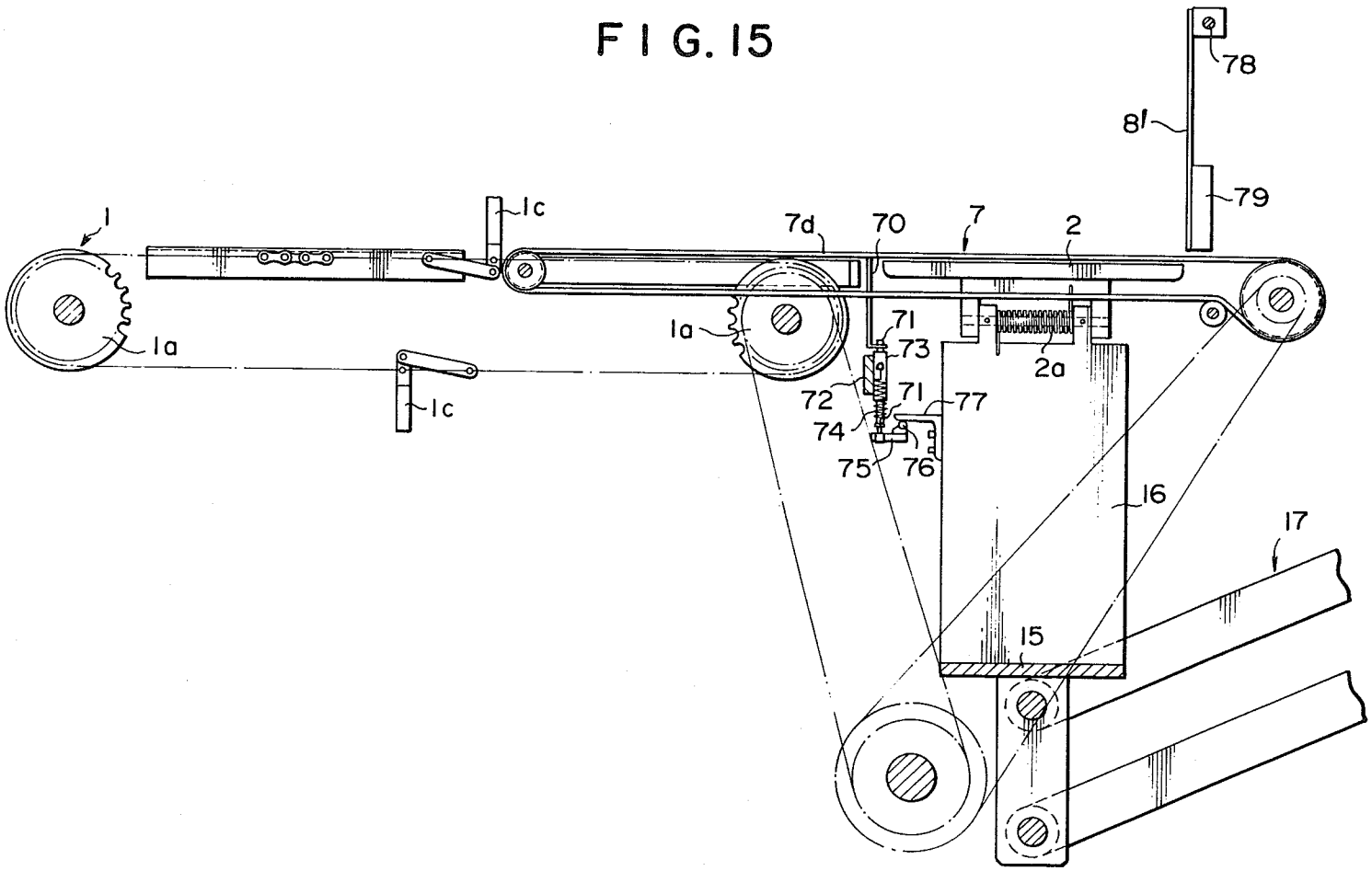
FIG. 15 is a longitudinal side elevational view in section for showing a modified form of an arrangement shown in FIG. 4.
Figure 16:
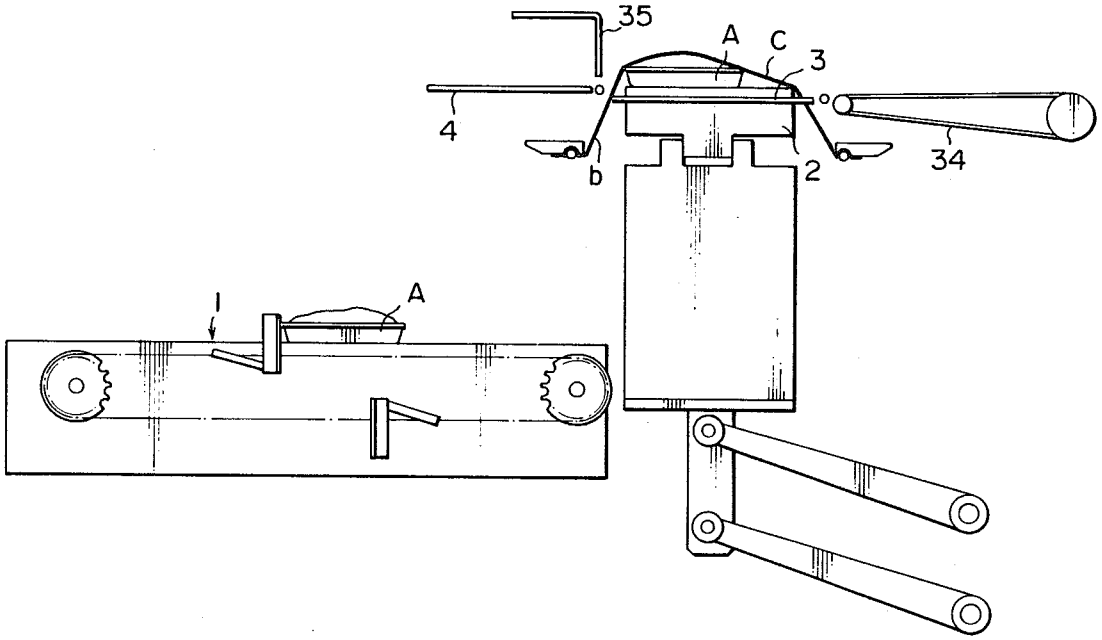
FIG. 16 PRIOR ART
FIG. 16 is a view for illustrating a principle of the conventional type of the structure.
Figure 17:
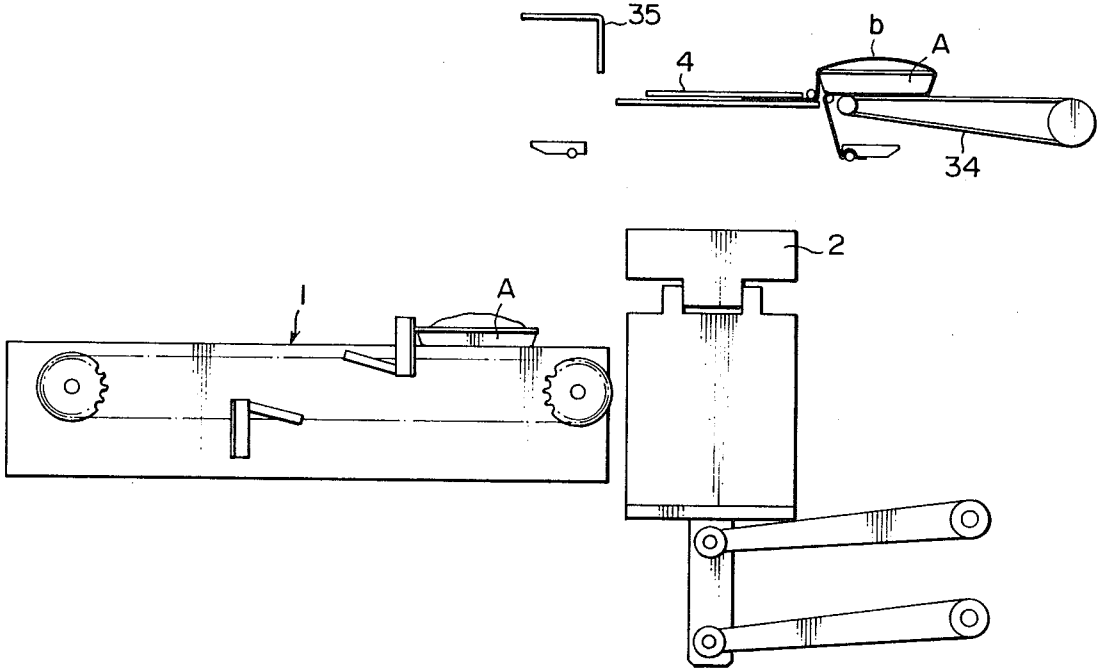
FIG. 17 PRIOR ART
FIG. 17 is a view for illustrating the operation of the unit.

FIG. 15 illustrates a modified form of the major part of the above-noted present invention, i.e., the belt conveyor and the position setting plate (see FIG. 4). In FIG. 15, the members which are also illustrated in FIG. 4 are designated by the same numbers and therefore explanation as to those elements will be eliminated.

In FIG. 15, belt conveyor 7 is fixed at its upper limit position without any upward or downward oscillating movement and includes vertically extending stopper 70 arranged in substantially the middle portion of belt 7*d* of conveyor 7 so that stopper 70 and belt 7*d* may be moved up and down. Stopper 70 has an L-shape. Supporting shaft 71 is connected to the lower end of the L-shaped stopper and extends downwardly. Supporting shaft 71 is inserted into guide pipe 73 slidably mounted on machine frame 10 via bracket 72 such that it may be slid in an upward or downward direction. Coil spring 74 is engaged with the lower end of supporting shaft 71 for biasing supporting shaft 71 upwardly. Engaging lever 75, which projects toward fixing plate 16 of elevator head 2, is integrally fixed to supporting shaft 71. The above-noted fixing plate 16 is integrally provided with operating rod 77 extending over engaging lever 75 and abutting roller 76 of engaging lever 75.

The upward and downward movement of fixing plate 16, that is, the upward and downward movement of elevator head 2 and the upward and downward movement of stopper 70 are cooperatively related to each other. That is, in FIG. 15, when elevator head 2 is placed at its lower limit position, stopper 70 is pushed down by operating lever 77 against the resilient force of coil spring 74 and positioned such that it is sunk below the lower half of belt 7d of belt conveyor 7. The item can be transported by belt conveyor 7. When elevator head 2 is moved upwardly, stopper 70 is projected over belt 7d under a resilient force of coil spring 74. When stopper 70 moves upwardly, the item A is prevented from being transported toward elevator head 2.

The arrangement for use in moving the above-noted stopper 70 upwardly or downwardly can be replaced with the arrangement in which belt conveyor 7 is moved upwardly or downwardly as shown in FIG. 4.

In FIG. 15, position setting plate 8′ is mounted such that its upper end is pivotably supported at supporting shaft 78. Position setting plate 8′ can be oscillated only in a rearward direction along the transporting direction of belt conveyor 7. Weight 79 is arranged at the lower end of position setting plate 8′. The arrangement of the above-noted position setting plate 8′ shows that the item A transported by belt conveyor 7 is abutted against position setting plate 8′ and stopped, thereafter it is slightly pushed back by the reaction force of position setting plate 8′. Therefore, even when the item A is transported while in an inclined position under the action of position setting plate 8′, the item can be adjusted to be at its right attitude after it abuts position setting plate 8′. Position setting plate 8′ restricts oscillation of the item from the condition shown to movement in the input direction.

Figure 18:
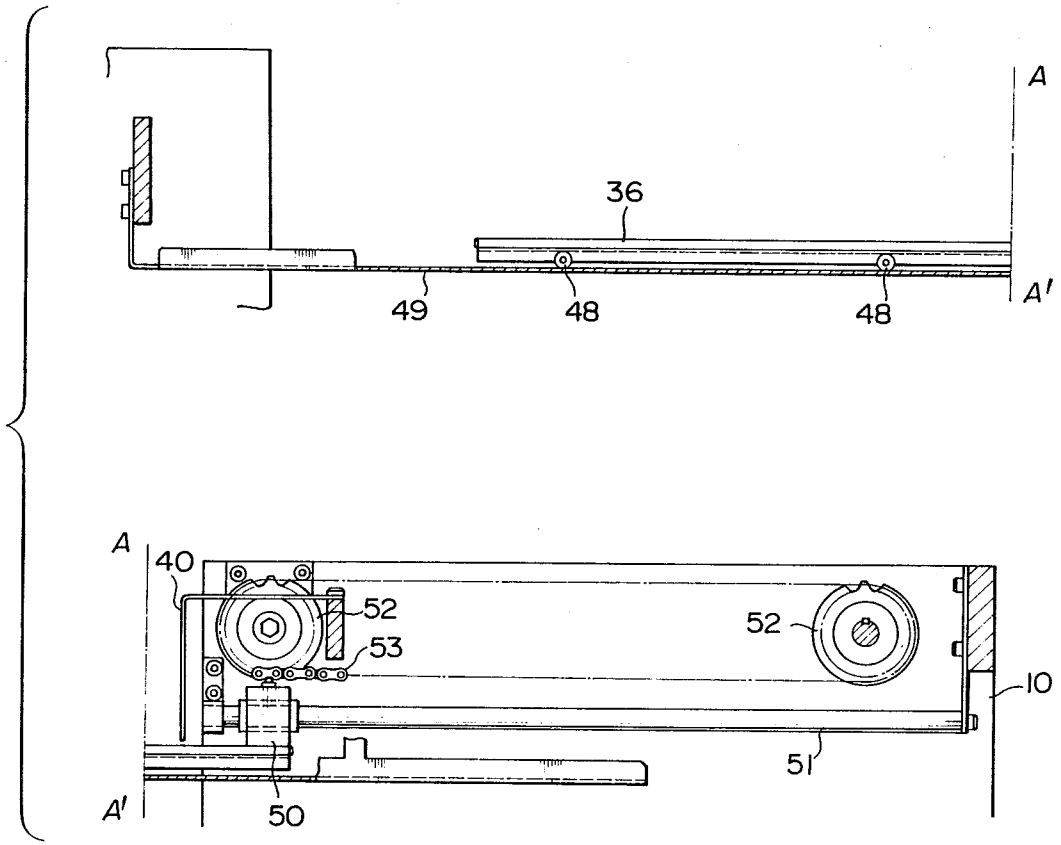
FIG. 18 is a front elevational view partly broken away for showing the part near the heating belt of the packaging machine in detail.
Figures 19, 19A:
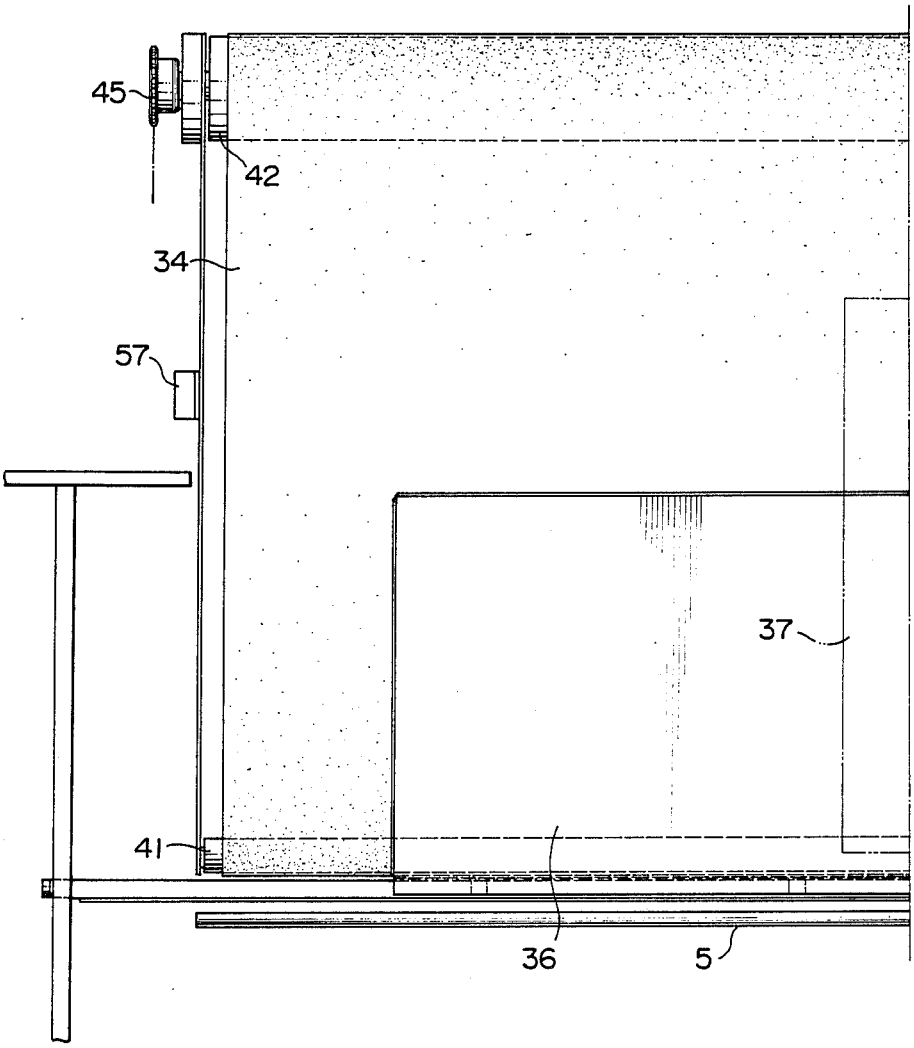
FIGS. 19, 19A and 19B is a top plan view of FIG. 18.
Figure 20:
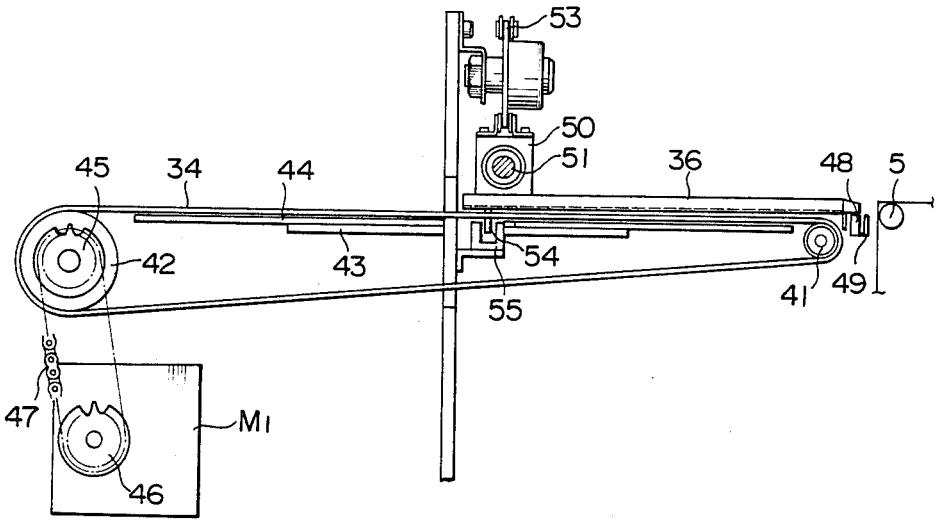
FIG. 20 is a side elevational view of FIG. 18 partly broken away.

In FIGS. 18 to 20, the detailed part near the above-noted heating belt 34, in particular, sliding plate 36 and its mechanism are illustrated. In FIGS. 18 to 20, position setting side plate 40 is arranged at one side of heating belt 34 and sliding plate 36 is arranged on heating belt 34 such that it may be flush with the upper surface of rear folding roller 5.

As shown in FIG. 20, heating belt 34 is provided with roller 41 freely rotatable positioned near rear folding roller 5, and with driving roller 42 positioned at the discharging end of belt 34. Heating belt 34 is placed around both rollers 41 and 42. Heater plate 44 having heater 43 fixed thereon is arranged below the upper half of heating belt 34 and the upper part of heating belt 34 is heated by heating plate 44. Driving roller 42 is driven by cooperation with sprocket 45, coaxially fixed to the roller, and sprocket 46, fixed to motor M via chain 47.

Side plate 40 has an L-shape, one surface of which is vertically arranged on heating belt 34 and the other surface of which is fixed to machine frame 10 parallel to the feeding direction of heating belt 34. The lower part of the vertical surface of side plate 40 has a clearance to enable sliding plate 36 to be passed therein. The vertical surface of side plate 40 may be provided with a resin plate having a low coefficient of friction.

Sliding plate 36 is a resin plate having a low coefficient of friction which projects outwardly from side plate 40 when the sliding plate is slid at the desired position on heating belt 34. Rear folding roller 5 of sliding plate 36 projects out of the end surface of heating belt 34 and at the same time the rollers 48 are rotatably arranged below the sliding plate 36. Rollers 48 are moved on rails 49 fixed over the width of heating belt 34. Sliding element 50 is fixed to sliding plate 36 projecting from side plate 40. Sliding element 50 is slidably fitted to guide rod 51 and moves along rod 51. Guide rod 51 is fixed to machine frame 10 so that sliding plate 36 can be moved by cooperation with sliding element 50 and sliding rod 51, in a direction perpendicular to the transferring direction of heating belt 34.

Figure 19B:
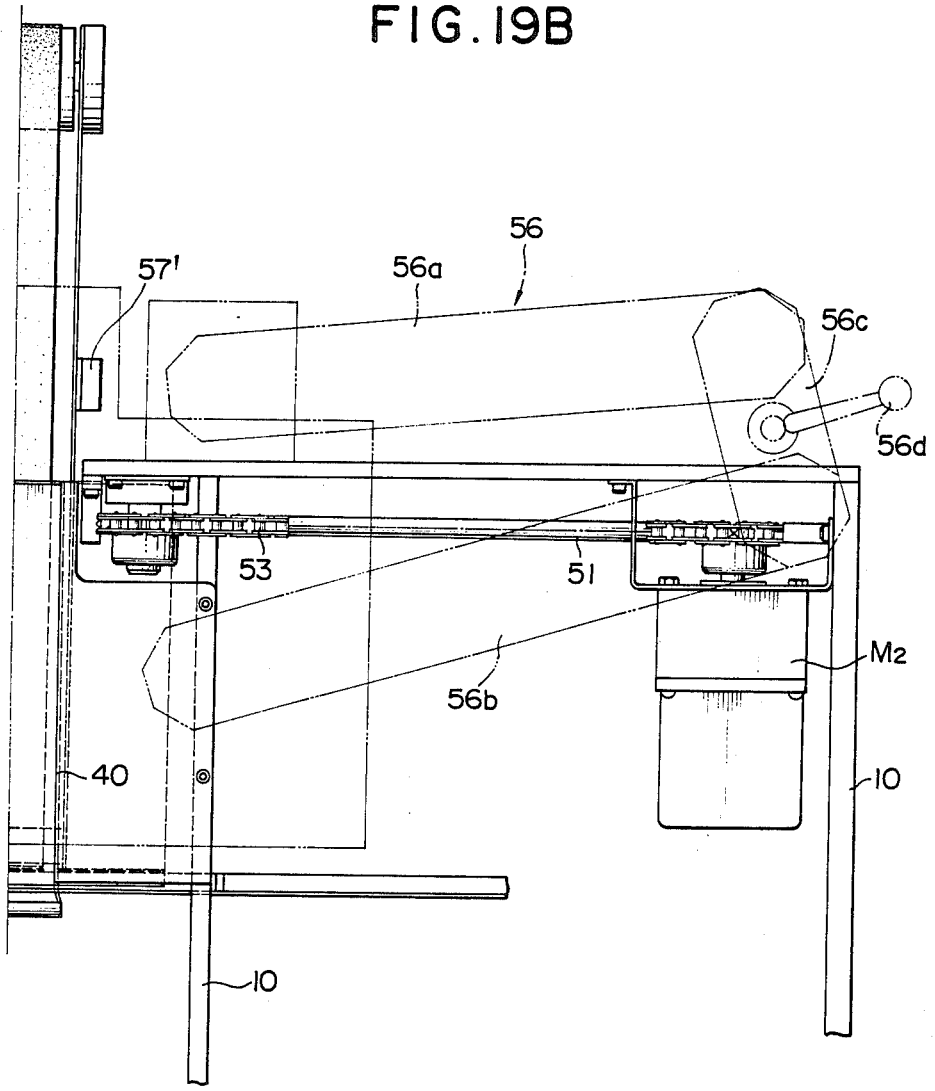

Each of the sprockets 52 are arranged above both ends of guide rod 51 such that chain 53 tensioned between sprockets 52 is parallel to guide rod 51 (FIGS. 18). Sliding element 50 is cooperatively related to chain 53. One of the sprockets 52 is driven by motor $M_2$ (FIG. 19B). Sliding plate 36 is slid from side plate 40 onto heating belt 34 or returned back to the outside of side plate 40, that is, off of heating plate 34, in response to the rotational direction of the motor $M_2$.

Projecting piece 54 (FIG. 20) is arranged below sliding plate 36 to which sliding element 50 is fixed. Projecting piece 54 is used for detecting the position where sliding plate 36 is slid onto the upper surface of heating belt 34 and the position where the sliding plate 36 is slid onto the upper surface of heating belt 34 and the position where the sliding plate is returned back to the outside of side plate 40. Photo-sensor 55 is arranged at each of the positions corresponding to projecting piece 54. When sliding plate 36 is slid onto the upper surface of heating belt 34, projecting piece 54 shuts off photo-sensor 55 and stops the motor $M_2$, so that sliding plate 36 is stopped. Similarly, sliding plate 36 stops the motor $M_2$ by the signal of the photo-sensor when it comes to the outside of side plate 40.

As shown in phantom in FIG. 19, label printer 37, arranged on the upper surface of heating belt 34, is supported by linkage mechanism 56. Linkage mechanism 56 is composed of three link members 56*a*, 56*b*, and 56*c*. Each of the link members is freely movable. Label printer 37 is rotatably arranged at one end of linkage mechanism 56. A fixing frame is rotatably arranged at the other end of linkage mechanism 56. The fixing frame is in turn fixed to machine frame 10. The label issuing port of label printer 37 can be moved to any position on heating belt 34 and its position can be fixed by handle or linkage member 56*a* arranged at one end of intermediate linkage member 56*c*. Transparent photo-sensors 57 and 57′ are arranged on both sides of heating belt 34 across its width in substantially the center of the length of belt 34. The items for which lateral folding is finished and which have been moved along heating belt 34 are detected by the photo-sensors.

Operation of the above-noted arrangement illustrated in FIGS. 18 to 20 will be described with reference to FIGS. 21 to 25.

Figure 21:
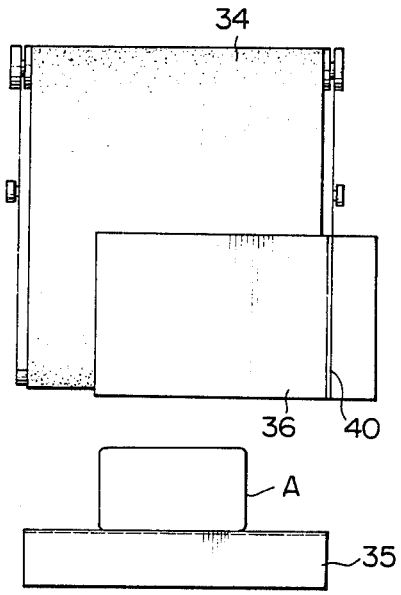
FIGS. 21 to 25 are top plan views for illustrating the operation of the arrangement shown in FIGS. 18 to 20.
Figure 22:
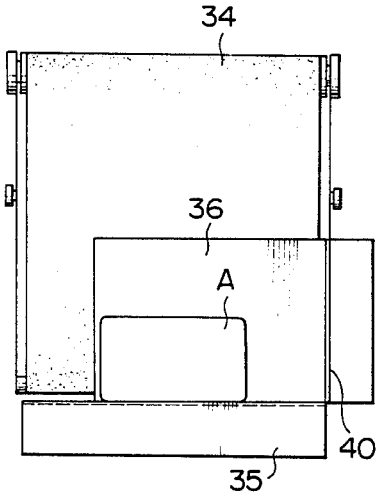

Sliding plate 36 is stopped on heating belt 34 where projecting piece 54 of sliding plate 36 is sensed by sensor 55 (FIG. 21). The item A, pushed by pusher 35, passes over rear folding roller 5 and the film is folded at the rear part of item A (see FIG. 8). Thereafter, the item is transported and deposited on sliding plate 36 (FIG. 22).

Figure 23:
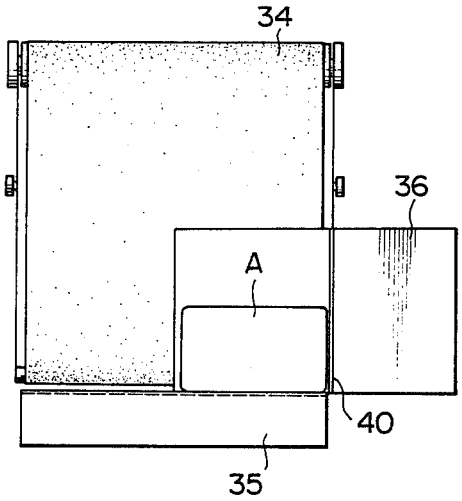

When the transporting operation of pusher 35 is completed and the item is transported onto sliding plate 36, motor $M_2$ is rotated and sliding plate 36 is slid under side plate 40. The item A on sliding plate 36 abuts side plate 40 as sliding plate 36 is moved (FIG. 23).

Figure 24:
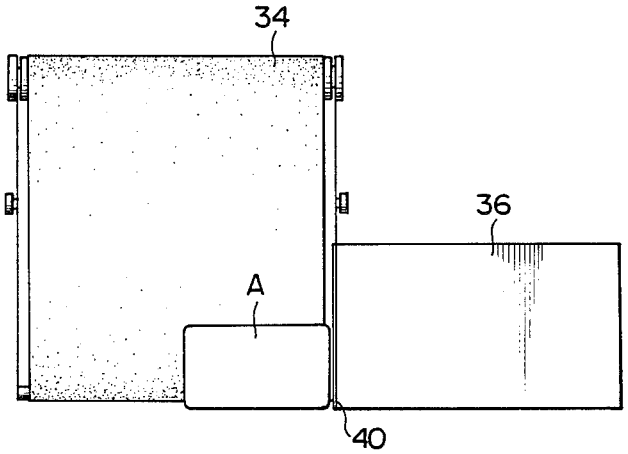

Further, as sliding plate 26 is moved and projecting piece 54 of sliding plate 36 is sensed by sensor 55, the rotation of motor $M_2$ is stopped by the sensed signal and the movement of sliding plate 36 is stopped (FIG. 24).

Figure 25:
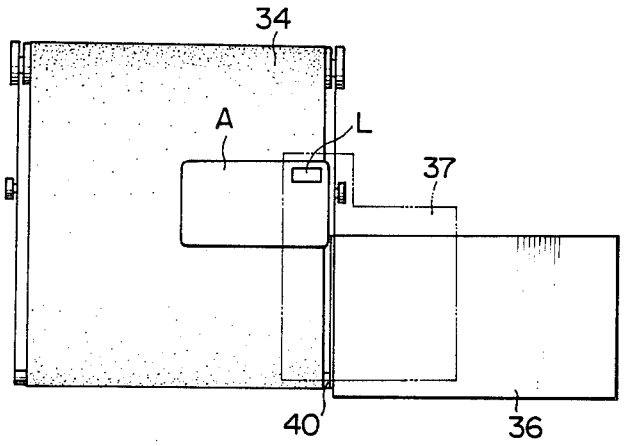

When the driving motor $M_1$ for heating belt 34 is started, heating belt 34 transports the item A in the output direction towards exit port 12. The item A is transported along side plate 40 and as the extreme end of the item A is detected by sensors 57 and 57′, the label L having weight, price and unit price, etc. is printed, issued, and suctioned and adhered to the upper surface of the end of the item A by compressed air in response to the detected signal (FIG. 25).

Further, the item A is fed out from heating belt 34 due to the rotation of heating belt 34.

As the next item is pushed up from below the stretch film by elevator head 2 and lateral folding is performed, front folding plate 4 is moved and, simultaneously, motor $M_2$ is energized to cause sliding plate 36 to be slid from side plate 40 onto the upper surface of heating belt 34. As sensor 55 detects projecting piece 54 of sliding plate 36, the rotation of motor $M_2$ is stopped by the sensing signal and sliding plate 36 keeps waiting on heating belt 34 as shown in FIG. 21. The above-noted operation is then repeated.

The label attachment position can be selected by varying the position of the label issuing port of label printer 37.

Figure 26:
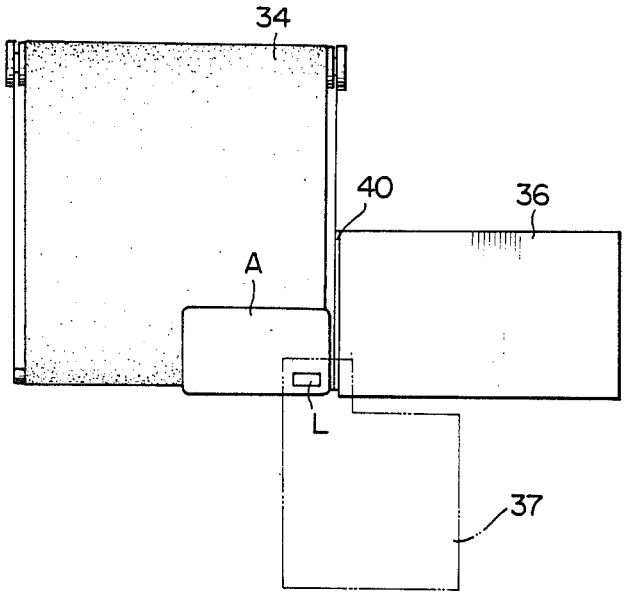
FIG. 26 is a top plan view for illustrating another operation in relation with FIGS. 18 to 20.

FIG. 26 illustrates the case where the label L is attached to the fore position of the item A.

Handle 56*d* arranged in linkage mechanism 56 of label printer 37 is loosened and the label issuing port of label printer 37 can be moved so that the label is attached to the fore position of the item A. The label issuing port position is fixed by handle 56*d*. The item A is transported by pusher 35, moved onto sliding plate 36 over rear folding roller 5. Pusher 35 finishes transportation of the item A onto sliding plate 36, the sliding plate 36 is slid so that the item A abuts side plate 40.

As sliding plate 36 is slid under side plate 40, the item A is transported onto heating belt 34. The label L having weighing data, etc. printed thereon is kept waiting under suctioned condition. The position of sliding plate 36 is detected by the sensor 55 for its complete return and then the label L is attached to the upper surface of the item A in response to the sensed signal. Heating belt 34 is rotated and the item A is transported. With this arrangement, the reference position of the item A is positively defined by pusher 35 and side plate 40, so that the attachment position of the label L can be positively defined.

It is also possible that the input side of the side plate 40 includes a switch mechanism, the switch mechanism being operated when the item A abuts side plate 40 and the label L is attached to the item A by the sensed signal.

Further, it may also be applicable that the operation of sliding plate 36 is performed when the item A is fed onto heating belt 34 and when the item A is transported from heating belt 34.

Figure 27:
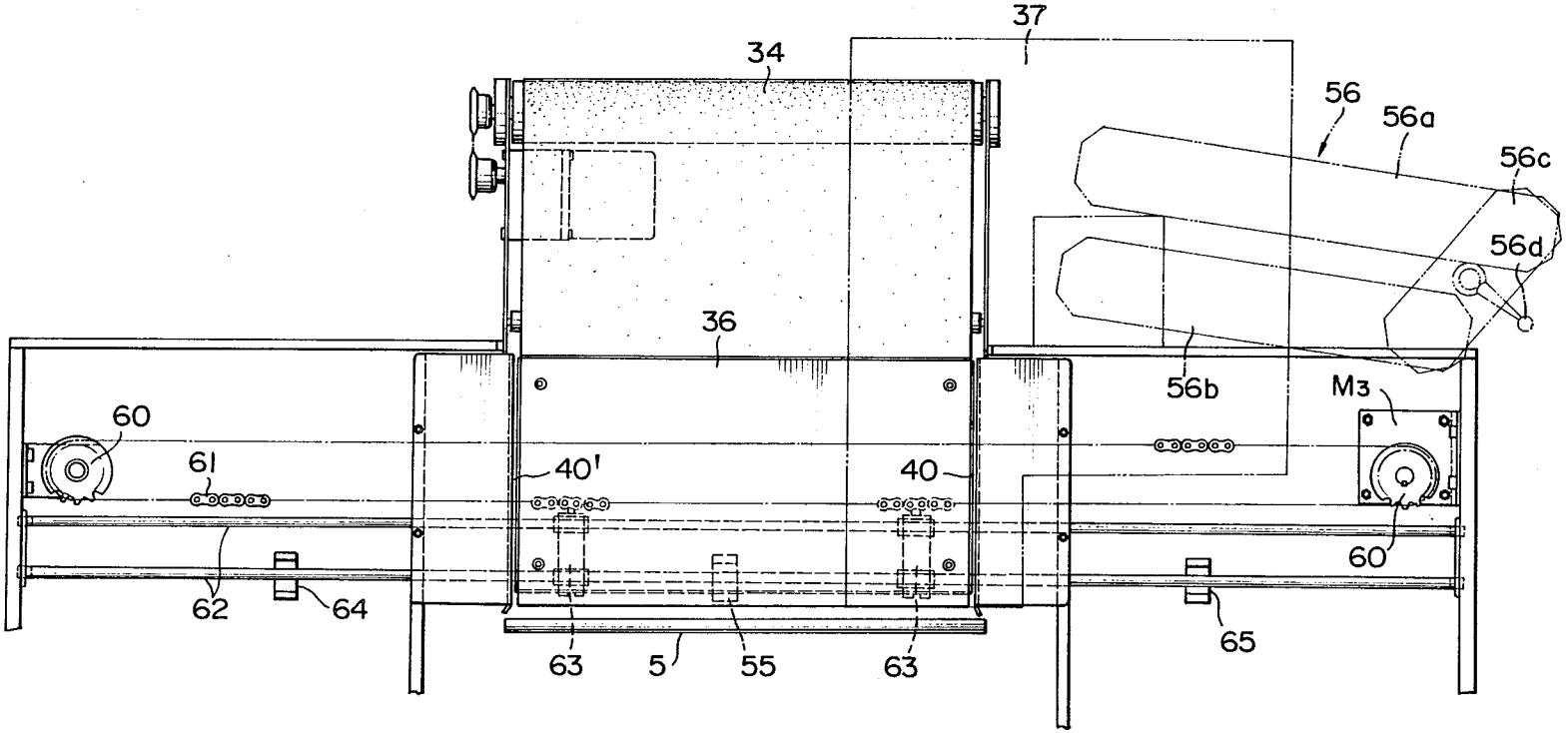
FIG. 27 is a top plan view for showing a modified form of a lateral aligning mechanism shown in FIGS. 18 to 20.
Figure 28:
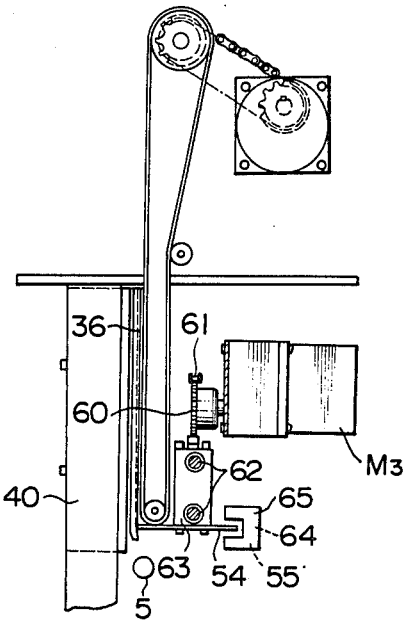
FIG. 28 is a side elevational view of FIG. 27.

With reference to FIGS. 27 and 28, a modified form of the present invention will be described in light of that shown in FIGS. 18 to 20, wherein the same elements as that of the abovenoted first preferred embodiment are designated by the same numbers. The description of common elements will be eliminated.

Each of side plates 40 and 40' are arranged at both sides of heating belt 34. Two sprockets 60 are arranged horizontally outside of each of side plates 40 and 40', and chain 61 is tensioned between sprockets 60.

Guide rods 62 are arranged parallel to chain 61. Sliding elements 63 are slidably fitted to guide rods 62 and sliding elements 63 are cooperatively related to chain 61.

Sliding elements 63 and sliding plate 36 are cooperatively related to each other and one of sprockets 60 is provided with motor $M_3$. Sensor 55 is arranged for use in sensing that sliding plate 36 is placed at the desired position on heating belt 34. Sensors 64 and 65 are arranged for sensing when sliding plate 36 is slid out from both side plates 40 and 40'.

Thus, in the preferred emodiment shown in FIGS. 27 and 28, sliding plate 36 is slid toward the right or left to enable it to be positioned at either the right or left side. Therefore, it is possible to adhere the label on either the right or left side of the item and further to arrange two rows of items by alternative rightward or leftward sliding of sliding plate 36.

As shown in FIGS. 18 to 28, the arrangement in which sliding plate 36 and position setting side plate 36 as well as a pair of side plates 40 and 40' are arranged on heating belt 34 enables the label to be always attached on the desired position on the item without any adjustment even if the size of the item A is varied, and further, high processing speed can be attained.

I claim:

1. A stretch film packaging machine for covering trays with stretch film comprising:

(a) a pusher conveyor for conveying said trays towards an entrance port of said stretch film packaging machine;

(b) at least one elevator head adapted to be moved between two positions for transporting said tray, said two positions comprising an upper position and a lower position, wherein said at least one elevator head is positioned at a downstream end of said pusher conveyor;

(c) means for positioning and cutting at least one stretch film to cover said trays, wherein said stretch film is adapted to be cut to a desired length and positioned above said at least one elevator head;

(d) a discharging passage for discharging said covered trays;

(e) at least one transporting belt extending from said pusher conveyor to said at least one elevator head wherein said at least one transporting belt is located between a transporting end of said pusher conveyor and said lower position of said at least one elevator head;

(f) a position setting plate positioned at a transporting end of said at least one transporting belt;

(g) a receiving passage located above said stretch film for receiving said tray;

(h) at least one folding plate arranged adjacent to a side of said receiving passage for folding said stretch film to cover said tray on said at least one elevator head when said at least one elevator head is moved toward said upper position;

(i) means for operating said pusher conveyor at a first predetermined operating speed;

(j) means for operating said at least one transporting belt at a second predetermined operating speed which is greater than said first predetermined operating speed of said pusher conveyor;

(k) a discharging pusher which is moveable towards said discharging passage;

(l) at least one side plate positioned parallel to a direction of said discharging said covered tray;

(m) at least one sliding plate including means for sliding the plate in a direction perpendicular to said at least one side plate wherein packaging trays are adapted to be pushed by said discharging pusher onto said at least one sliding plate; and (n) a heating belt aligned with said discharging passage, said at least one sliding plate mounted over said heating belt.

2. A stretch film packaging machine for covering trays with stretch film comprising:

(a) a pusher conveyor for conveying said trays toward an entrance port of said stretch film packaging machine;

(b) at least one elevator head adapted to be moved between two positions for transporting said tray, said two positions comprising an upper position and a lower position, wherein said at least one elevator head is positioned at a downstream end of said pusher conveyor;

(c) means for positioning and cutting at least one stretch film to cover said trays, wherein said stretch film is adapted to be cut to a desired length and positioned above said at least one elevator head;

(d) a discharging passage for discharging said covered trays;

(e) at least one transporting belt extending from said pusher conveyor to said at least one elevator head, wherein said at least one transporting belt is located between a transporting end of said pusher conveyor and said at least one elevator head when in said lower position;

(f) a position setting plate positioned at a transporting end of said at least one transporting belt;

(g) a receiving passage located above said stretch film for receiving said tray;

(h) at least one folding plate arranged adjacent to a side of said receiving passage for folding said stretch film to cover said tray on said at least one elevator head when said at least one elevator head is moved toward said upper position;

(i) means for operating said at pusher conveyor at a first predetermined operating speed, (j) means for operating said at least one transporting belt at a second predetermined operating speed which is greater than said first predetermined operating speed of said pusher conveyor; and (k) means for moving said at least one transporting belt vertically between first and second belt positions in response to movement of said at least one elevator head from said lower to said upper position and from said upper to said lower position.

3. A stretch film packaging machine according to claim 2 further comprising means for moving said at least one transporting belt upwardly in said first belt position for enabling transportation of said tray when said at least one elevator head is moved downwardly to said lower position and means for moving said at least one transporting belt downwardly in said second belt position for disabling transportation of said tray when said at least one elevator head is moved upwardly to said upper position.

4. A stretch film packaging machine for covering trays with stretch film comprising:

(a) a pusher conveyor for conveying said trays toward an entrance port of said stretch film packaging machine;

(b) at least one elevator head adapted to be moved between two positions for transporting said tray, said two positions comprising an upper position and a lower position, wherein said at least one elevator head is positioned at a downstream end of said pusher conveyor;

(c) means for positioning and cutting at least one stretch film to cover said trays, wherein said stretch film is adapted to be cut to a desired length and positioned above said at least one elevator head;

(d) a discharging passage for discharging said covered trays;

(e) at least one transporting belt extending from said pusher conveyor to said at least one elevator head wherein said at least one transporting belt is located between a transporting end of said pusher conveyor and said at least one elevator head when in said lower position;

(f) a position setting plate positioned at a transporting end of said at least one transporting belt;

(g) a receiving passage located above said stretch film for receiving said tray;

(h) at least one folding plate arranged adjacent to a side of said receiving passage for folding said stretch film to cover said tray on said at least one elevator head when said at least one elevator head is moved toward said upper position;

(i) means for operating said pusher conveyor at a first predetermined operating speed;

(j) means for operating said at least one transporting belt at a second predetermined operating speed which is greater than said first predetermined operating speed of said pusher conveyor; and (k) first and second side guide bars positioned at two sides of said receiving passage located above said at least one elevator head;

(l) a pair of first sliding members, one of said pair of first sliding members being slidably engaged with said first side guide bar and another of said pair of first sliding members being slidably engaged with said second slide guide bar;

(m) a pair of second sliding members, one of said second pair of second sliding members being slidably engaged with said first side guide bar and another of said pair of second sliding members being slidably engaged with said second side guide bar, (n) a first folding plate positioned over said pair of first sliding members, said first folding plate being reciprocable towards said receiving passage;

(o) a first drive shaft cooperatively related to said one of said pair of first sliding members via a first crank mechanism;

(p) a discharging pusher positioned over said pair of second sliding members, said discharging pusher being reciprocated towards said discharging passage; and (q) a second drive shaft cooperatively related to said one of said pair of second sliding members via a second crank mechanism.

5. A stretch film packaging machine according to claim 4 wherein (a) said first and second crank mechanisms are of substantially similar construction; and (b) said first drive shaft and second drive shafts are symmetrically arranged about a substantially central portion of said receiving passage.

6. A stretch film packaging machine according to claim 5 wherein (a) said first folding plate and discharge pusher are positioned on an opposite said of said receiving passage from said discharge passage;

(b) said entrance port and an exit port are arranged at the same side of a frame of said machine; and (c) said at least one transporting belt is fixed at a position which is flush with said pusher conveyor.

7. A stretch film packaging machine according to claim 6 wherein said discharge passage comprises:

(a) at least one sliding plate positioned parallel to a direction of said discharging said covered tray;

(b) means for sliding said at least one sliding plate in a direction perpendicular to said at least one side plate wherein packaged trays being adapted to be pushed by said discharging pusher onto said at least one sliding plate.

8. A stretch film packaging machine according to claim 7 further comprising a heating belt aligned with said discharging passage, said at least one sliding plate mounted over said heating belt.

9. A stretch film packaging machine according to any one of claims 8 or 1 further comprising
(a) a label printer positioned above said heating belt for attaching a label on said packaged item; and
(b) a weighing part positioned at a starting end of said pusher conveyor for weighing said tray.

10. A stretch film packaging machine according to claim 7 or 1 wherein said at least one side plate comprises a pair of side plates positioned parallel to one another in a predetermined spaced-apart relationship to both sides of said heating belt and wherein said machine further comprises means for sliding said at least one said sliding plate towards said pair of side plates.

11. A stretch film packaging machine for packaging trays with stretch film, the trays being placed on a heating belt, said machine being adapted to apply a bottom seal to said trays, and a label printer for issuing a label to be adhered to said trays, said machine comprising:
(a) at least one position setting side plate arranged at a side of said heating belt;
(b) at least said one sliding plate positioned over an upper surface of a feeding part of said heating belt;
(c) means for sliding said at least one sliding plate along the width of said heating belt,
wherein said trays are movable onto said at least one sliding plate, said means for sliding said at least one sliding plate moves such that said trays abut said at least one position setting side plate, and thereby moved onto said heating belt and discharged along said at least one side plate.

12. A stretch film packaging machine according to claim 11 wherein
(a) said at least one position setting side plate has an L-shape;
(b) a first surface of said at least one position setting side plate is arranged vertically on said heating belt;
(c) a second surface of said at least one position setting side plate is fixed to a machine frame such that said second surface is parallel to a transporting direction of said heating belt; and
(d) said at least one sliding plate is slidably arranged at a lower portion of said first surface of said at least one side plate.

13. A stretch film packaging machine according to claim 11, wherein:
(a) said at least one position setting side plate comprises a pair of position setting side plate comprises a pair of position setting side plates positioned in parallel in a predetermined spaced-apart relationship to one another at both side of said heating belt; and
(b) said at least one sliding plate including means for sliding said sliding plate towards either of said side plates.

14. A method of packaging a tray with stretch film using a stretch film packaging machine comprising the steps of:
(a) transporting said tray toward an entrance port of said machine on a pusher conveyor in response to a weighing signal, said pusher conveyor being operated at a first predetermined operating speed;
(b) transporting said tray toward at least one elevator head on at least one transporting belt, said at least one transporting belt being positioned between said pusher conveyor and said at least one elevator head, said at least one transporting belt being operated at a second predetermined operating speed which is greater than the first predetermined operating speed of said pusher conveyor;
(c) pushing said tray onto said at least one elevator head into a position on said at least one elevator head defined by a position setting plate;
(d) packaging said tray with stretch film comprising the steps of:
(i) detecting the size of said tray;
(ii) cutting a piece of stretch film to an appropriate size responsive to said detecting step;
(iii) positioning said cut piece of stretch film over said at least one elevator head;
(iv) raising said at least one elevator head towards said cut piece of said stretch film until said film is draped over said tray;
(v) folding said film under said tray on each of the two lateral sides of said tray;
(vi) folding said film under said tray on a front side of said tray;
(vii) pushing said tray onto at least one sliding plate positioned over a heating belt in said machine thereby folding said film under said tray on a rear side of said tray;
(e) discharging said tray from said machine, wherein the step of discharging said tray comprises the steps of:
(i) withdrawing said at least one sliding plate from said heating belt such that said tray is moved onto said heating belt abutting against at least one side plate;
(ii) activating said heating belt such that said film is sealed under said tray; and
(iii) pushing said sealed tray out of said machine.

15. A stretch film packaging machine according to claim 9 wherein said pusher conveyor is turned on for pushing one of said trays onto said at least one transporting belt in response to a weighing stable signal generated by said weighing part.

16. A stretch film packaging machine according to claim 5 further comprising first and second guide rails positioned at two sides of said receiving passage located above said at least one elevator head, said first and second guide rails being positioned perpendicular to said first and second side guide bars.

17. A stretch film packaging machine for covering trays with stretch film comprising:
(a) a pusher conveyor for conveying said trays toward an entrance port of said stretch film packaging machine;
(b) at least one elevator head for transporting said tray adapted to be moved between an upper and a lower position;
(c) at least one stretch film for covering said trays;
(d) a discharging passage for discharging the covered trays;
(e) at least one transporting belt extending from said pusher conveyor to said at least one elevator head and adapted to move vertically between first and second belt positions in response to movement of said at least one elevator head from said lower to said upper position and from said upper to said lower position;
(f) a position setting plate positioned at a transporting end of said at least one transporting belt;

(g) means for moving said at least one transporting belt upwardly in said first belt position for enabling transportation of said tray when said at least one elevator head is moved downwardly to said lower position; and (h) means for moving said at least one transporting belt downwardly in said second belt position for disabling transportation of said tray when said at least one elevator head is moved upwardly to said upper position.

* * * * *

UNITED STATES PATENT AND TRADEMARK OFFICE

CERTIFICATE OF CORRECTION

PATENT NO. : 4,709,531

DATED : December 1, 1987

INVENTOR(S) : Toshio DENDA

It is certified that error appears in the above-identified patent and that said Letters Patent is hereby corrected as shown below:

At column 1, line 65, insert ---,--- after "3'".
At column 2, line 39 change "effect" to ---affect---.

At column 4, line 8 of the printed patent, change "is" to --are---.
At column 4, line 8 change "is" to ---are---.
At column 5, line 64, change "lengeth" to ---length---.
At column 11, line 60 change "FIGS." to ---FIG.---.
At column 12, line 47 change "26" to ---36---.
At column 13, line 60 change "emodiment" to ---embodiment---.
At column 15, line 24
delete "at" after "said".

Signed and Sealed this

Twenty-sixth Day of July, 1988

*Attest:*

DONALD J. QUIGG

*Attesting Officer*

*Commissioner of Patents and Trademarks*